US005499020A

United States Patent [19]

Motohashi et al.

[11] Patent Number: 5,499,020

[45] Date of Patent: Mar. 12, 1996

[54] DATA DISPLAY RADIO PAGER

[75] Inventors: Teruyuki Motohashi, Tokyo; Kazumori Yamada, Shizuoka, both of Japan

[73] Assignee: NEC Corporation, Tokyo, Japan

[21] Appl. No.: 929,383

[22] Filed: Aug. 14, 1992

[30] Foreign Application Priority Data

Aug. 15, 1991 [JP] Japan ..... 3-229491

[51] Int. Cl.[6] ..... G08B 5/22

[52] U.S. Cl. ..... 340/825.44; 368/10; 368/12

[58] Field of Search ..... 340/825.44, 309.15, 340/309.2, 309.3; 455/38.4; 368/10, 12, 107–109, 244, 250

[56] References Cited

U.S. PATENT DOCUMENTS 4,712,923 12/1987 Martin ..... 368/10

4,872,005 10/1989 DeLuca et al. ..... 340/825.44

5,107,469 4/1992 Dodson ..... 368/250

FOREIGN PATENT DOCUMENTS

57734/90 6/1990 Australia .

0495651 7/1992 European Pat. Off. .

2918531 11/1980 Germany .

3531831 3/1987 Germany .

60-106237 6/1985 Japan .

3-18137 1/1991 Japan .

WO89/06478 7/1989 WIPO .

*Primary Examiner*—Michael Horabik

*Attorney, Agent, or Firm*—Foley & Lardner

[57] ABSTRACT

A data display radio pager for producing, on receiving a signal including a preassigned address number, an alert and displaying a message also included in the signal on a display. When the radio pager receives a signal including a message with time data, it again alerts the user of the radio pager and displays the message on the display at a particular time based on the time data contained in the message.

6 Claims, 10 Drawing Sheets

Fig. 6

| Bit.NO 7 6 5 4 3 2 1 | 0 1 0 | 0 1 1 | 1 0 0 | 1 0 1 |
|---|---|---|---|---|
| 0 0 0 0 | SP | 0 | @ | P |
| 0 0 0 1 | ! | 1 | A | Q |
| 0 0 1 0 | " | 2 | B | R |
| 0 0 1 1 | # | 3 | C | S |
| 0 1 0 0 | $ | 4 | D | T |
| 0 1 0 1 | % | 5 | E | U |
| 0 1 1 0 | & | 6 | F | V |
| 0 1 1 1 | ' | 7 | G | W |
| 1 0 0 0 | ( | 8 | H | X |
| 1 0 0 1 | ) | 9 | I | Y |
| 1 0 1 0 | * | : | J | Z |
| 1 0 1 1 | + | ; | K | [ |
| 1 1 0 0 | , | < | L | \ |
| 1 1 0 1 | - | = | M | ] |
| 1 1 1 0 | . | > | N | ^ |
| 1 1 1 1 | / | ? | O | _ |

Fig. 7

10 : 05

1 : 05

18 : 05

DATA DISPLAY RADIO PAGER

BACKGROUND OF THE INVENTION

The present invention relates to a data display radio pager and, more particularly, to a data display radio pager capable of, when received a signal including a message with time data, again alerting the user of the radio pager and displaying the message on a display as a particular time based on the time data arrives.

A data display radio pager for producing, on receiving a signal including a preassigned address number, sound, vibration or similar alert while displaying a message also included in the received signal on a display is conventional. This type of radio pager usually has an antenna, a radio section, a decoder, a ROM (Read Only Memory), a speaker driver, a speaker, a display driver, a display, a reset switch, a timepiece, etc. A signal coming in through the antenna is routed though the radio section to the decoder. The decoder compares an address number included in the received signal with an address number stored in the ROM and preassigned to the radio pager. If the two address numbers are identical, the decoder causes the speaker driver to produce an alert tone via the speaker, thereby informing the user of the radio pager of the received call. When the address number or address signal included in the received signal is followed by a message signal, the decoder decodes the message signal and then displays it on the display via the display driver while writing it in a memory. Afterwards, the user may operate the reset switch to see the message again. Then, the decoder will read the message out of the memory and displays it on the display again. Further, the decoder displays the time being counted by the timepiece on the display by controlling the display driver, allowing the user to see the current time.

With the radio pager having the above construction, it is possible not only to alert the user to a call but also to impart a message, e.g., "GO TO ABC COMPANY AT 15:00" to the user. This makes it needless for the user to confirm the reason for the call on a telephone or similar means afterwards. However, assume that the received message includes an appointed time which is a substantial period of time later than the time of reception of the message, e.g., the above message "GO TO ABC COMPANY AT 15:00" is received at 10:00. Then, the interval between the reception of the message and the appointed time may be too long for the user to surely recall the appointed time on the approach of the time. Forgetting the message, i.e., appointment would, of course, lead to the loss of credit or even to the break-off of business relations.

SUMMARY OF THE INVENTION

It is therefore an object of the present invention to provide a data display radio pager capable of again producing, when the received signal includes a message with time data, an alert and displaying the message on a display when a particular time based on the time data arrives, thereby positively urging the user to reconfirm the message received in the past.

In accordance with the present invention, a data display radio pager for producing, on receiving a signal including a preassigned number, an alert and displaying a message also included in the signal on a display comprises a time message identifying circuit for determining whether or not the received signal includes time data, a memory for storing a message determined to include time data by the time message identifying circuit, a realert commanding circuit for watching a realert time for alerting the user of the data display radio pager to the message again on the basis of the time data included in the message, and on the arrival of the alert time producing a realert command, and a realerting circuit for producing, on receiving the realert command from the realert commanding circuit, an again and displaying the message with time data stored in the memory on the display again.

BRIEF DESCRIPTION OF THE DRAWINGS

The above and other objects, features and advantages of the present invention will become more apparent from the following detailed description taken with the accompanying drawings in which:

FIG. 6 shows a specific data code table based on POCSAG code;

FIG. 7 shows possible patterns indicative of time;

FIGS. 10–12 show how to set up a realert mode particular to the embodiment;

FIG. 13 is a key to the reconstruction of FIGS. 13A and 13B.

DESCRIPTION OF THE PREFERRED EMBODIMENT

Figure 1:
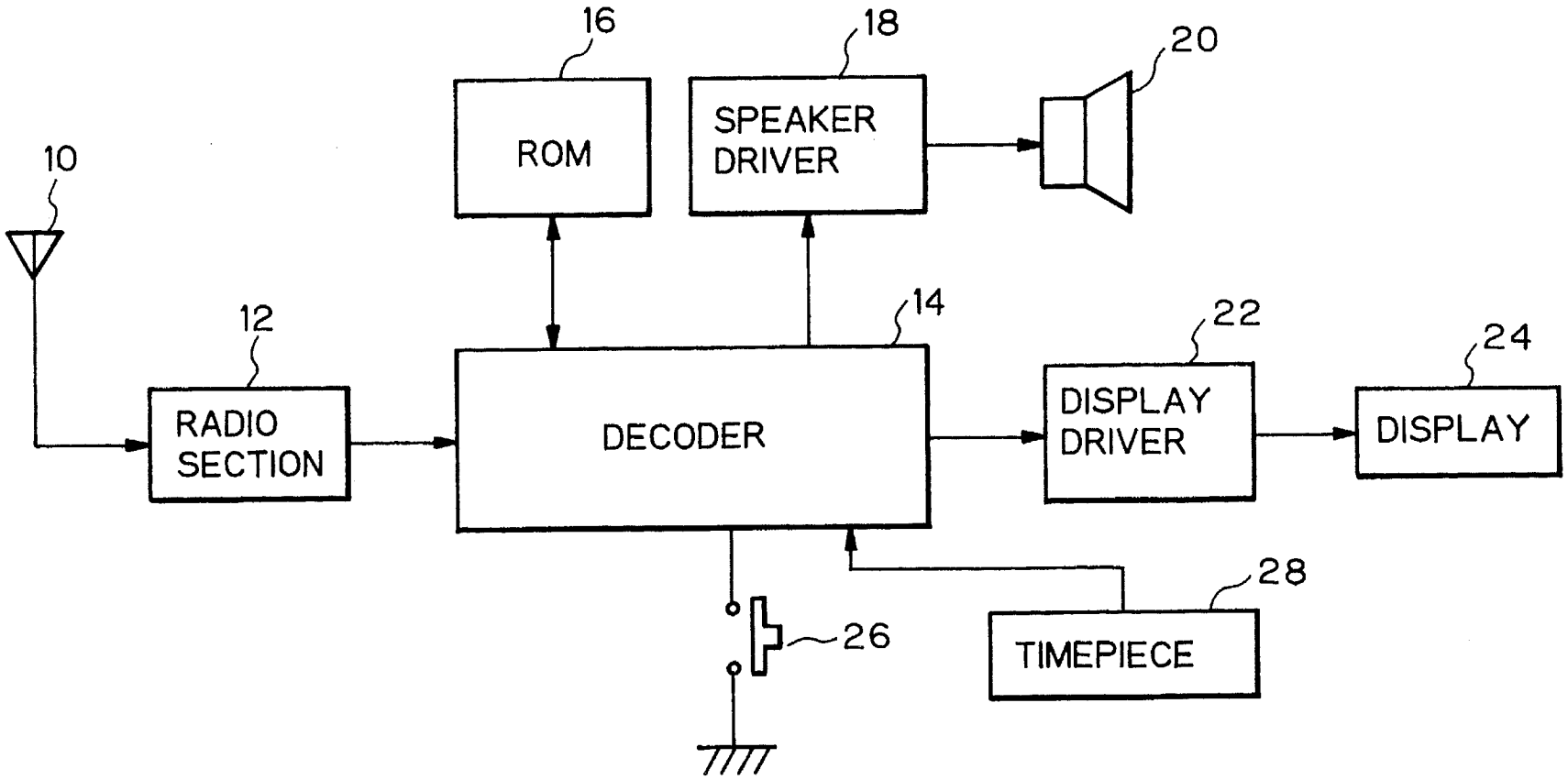
Fig. 1 PRIOR ART
FIG. 1 is a block diagram schematically showing a conventional data display radio pager.

To better understand the present invention, a brief reference will be made to a conventional data display radio pager, shown in FIG. 1. As shown, the radio pager has an antenna 10, a radio section 12, a decoder 14, a ROM 16, a speaker driver 18, a speaker 20, a display driver 22, a display 24, a reset switch 26, and a timepiece 28.

In operation, a signal coming in through the antenna 10 is routed though the radio section 12 to the decoder 14. The decoder 14 compares an address number included in the received signal with an address number stored in the ROM 16 and preassigned to the radio pager. If the two address numbers are identical, the decoder 14 causes the speaker driver 18 to produce an alert tone via the speaker 20, thereby informing the user of the radio pager of the received call. When the address number or address signal included in the received signal is followed by a message signal, the decoder 14 decodes the message signal and then displays it on the display 24 via the display driver 22 while writing it in a memory, not shown. Afterwards, the user may operate the reset switch 26 to see the message again. Then, the decoder 14 will read the message out of the memory, not shown, and displays it on the display 24 again. Further, the decoder 14 displays the time being counted by the timepiece 28 on the display 24 by controlling the display driver 22, allowing the user to see the current time.

With the radio pager having the above construction, it is possible not only to alert the user to a call but also to impart a message, e.g., "GO TO ABC COMPANY AT 15:00" to the user. This makes it needless for the user to confirm the reason for the call on a telephone or similar means later. However, assume that the received message includes an appointed time which is a substantial period of time later than the time of reception of the message, e.g., the above message "GO TO ABC COMPANY AT 15:00" is received at 10:00. Then, the interval between the reception of the message and the appointed time may be too long for the user to surely recall the appointed time on the approach of the time, as previously stated.

Figure 2:
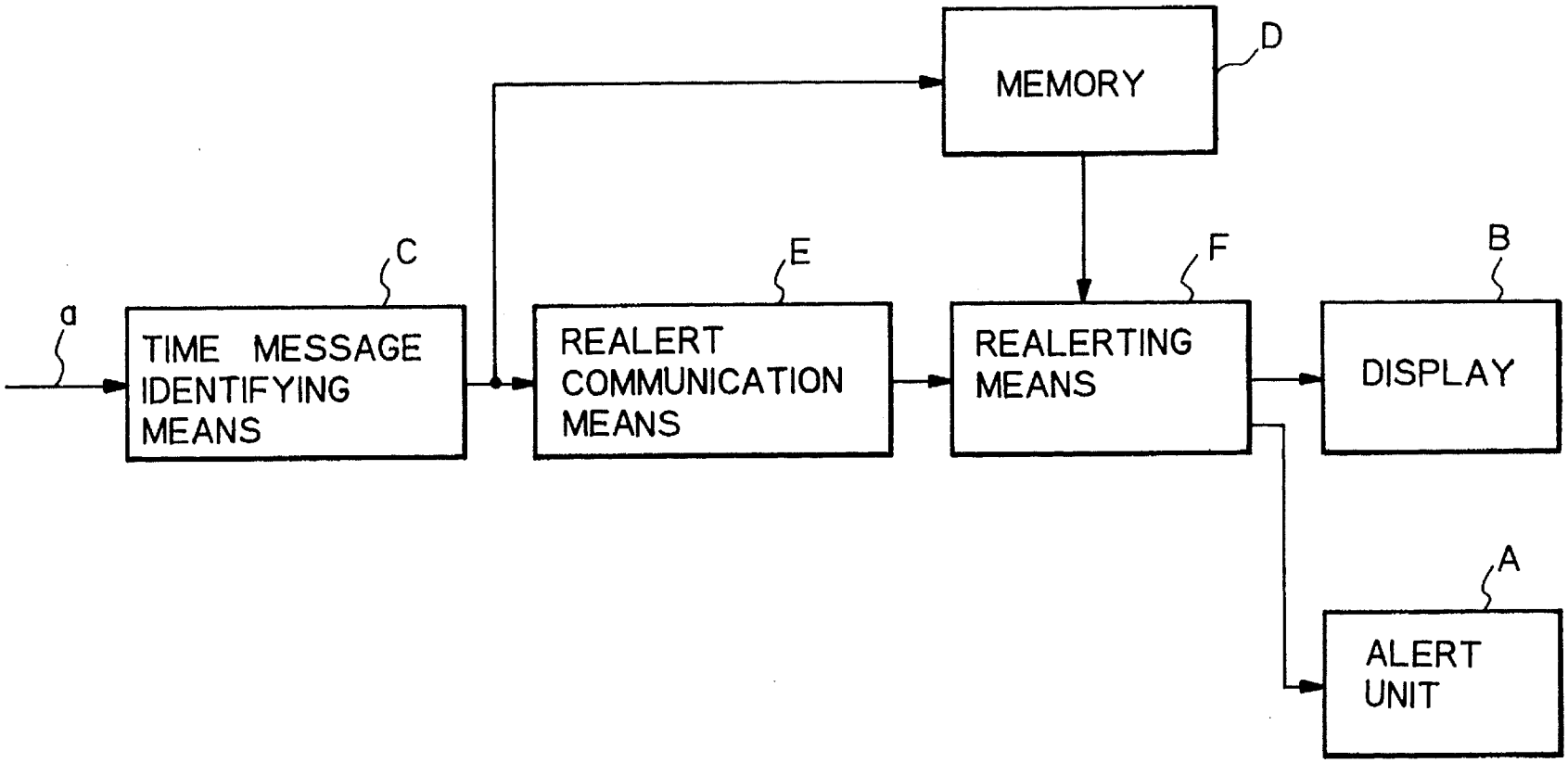
FIG. 2 is a block diagram schematically showing the principle of the present invention.

Referring to FIG. 2, the principle of a data display radio pager of the present invention is schematically shown. As shown, on receiving a signal α including an address number identical with a preassigned address number, the radio pager alerts the user to a call via an alert unit A while displaying a message also included in the signal α on a display B. Time message identifying means C determines whether or not the message included in the signal α contains time data. A memory D stores a message or messages which are determined to contain time data by the time message identifying means. Realert commanding means E watches a realert time for producing an alert again and based the time data determined by the time message identifying means C and, on the arrival of the realert time, generates a realert command. Realerting means F causes the alert unit A to again produce an alert again and displays the message of interest stored in the memory D on the display B in response to the realert command from the realert commanding means E. The time message identifying means C determines that the message of the received signal α contains time data if at symbol commonly used to indicate time is present in the message, preceded by one or two numerals, and followed by two numerals.

Figure 3:
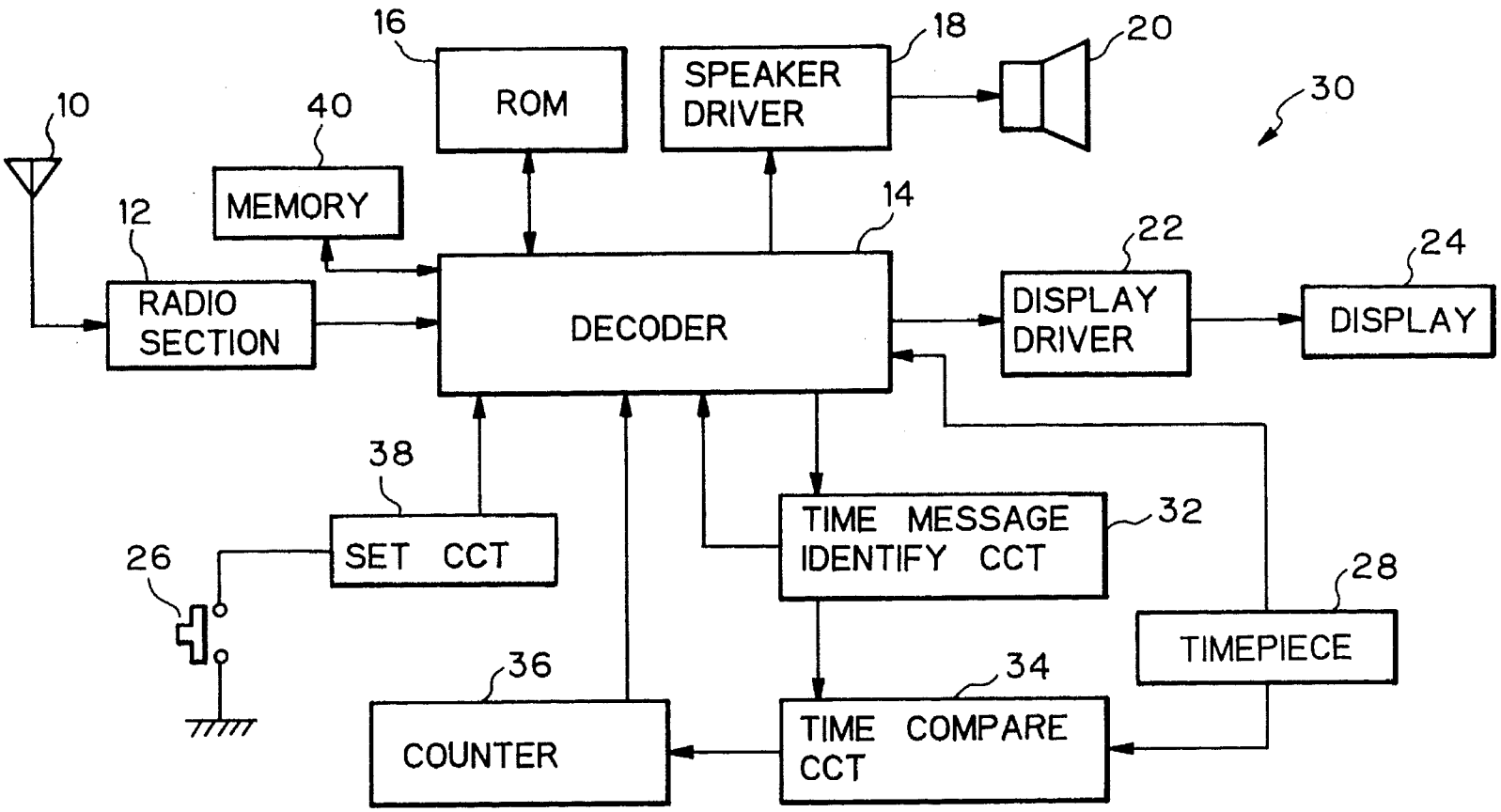
FIG. 3 is a schematic block diagram showing a data display radio pager embodying the present invention.

Specifically, as shown in FIG. 3, a data display radio pager, generally 30, embodying the present invention has a time message identifying circuit 32, a time comparing circuit 34, a counter 36, a setting circuit 38, and a memory 40 in addition to the antenna 10, radio section 12, decoder 14, ROM 16, speaker driver 18, speaker 20, display driver 22, display 24, reset switch 26, and timepiece 28.

In operation, a signal coming in through the antenna 10 is routed though the radio section 12 to the decoder 14. The decoder 14 compares an address number included in the received signal with a preassigned address number stored in the ROM 16. If the two address numbers are identical, the decoder 14 causes the speaker driver 18 to produce an alert tone via the speaker 20, thereby informing the user of the radio pager of the received call. When the address number or address signal included in the received signal is followed by a message signal, the decoder 14 decodes the message signal and then displays it on the display 24 via the display driver 22. At the same time, the decoder 14 feeds the message to the time message identifying circuit 32. In response, the time message identifying circuit 32 determines whether or not the message contains time data and then delivers the result of decision to the decoder 14. Then, if the message contains time data, the decoder 14 indicates the presence of time data on the display 24.

Figure 4:
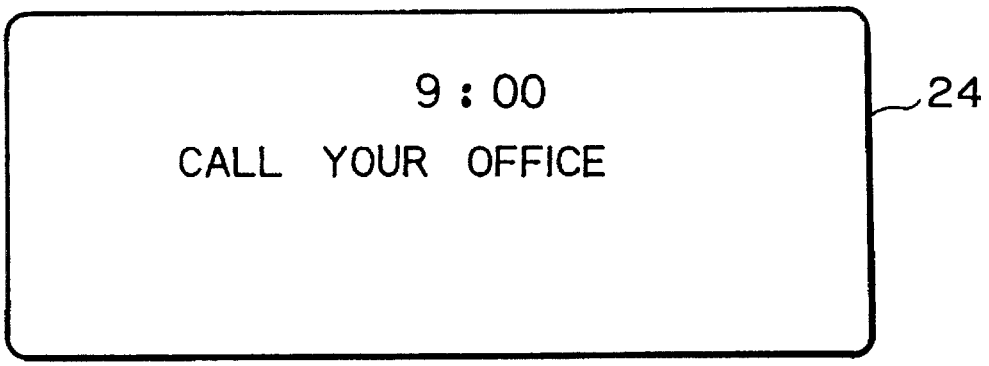
FIG. 4 shows a specific message not including time data and appearing on a display included in the embodiment.
Figure 5:
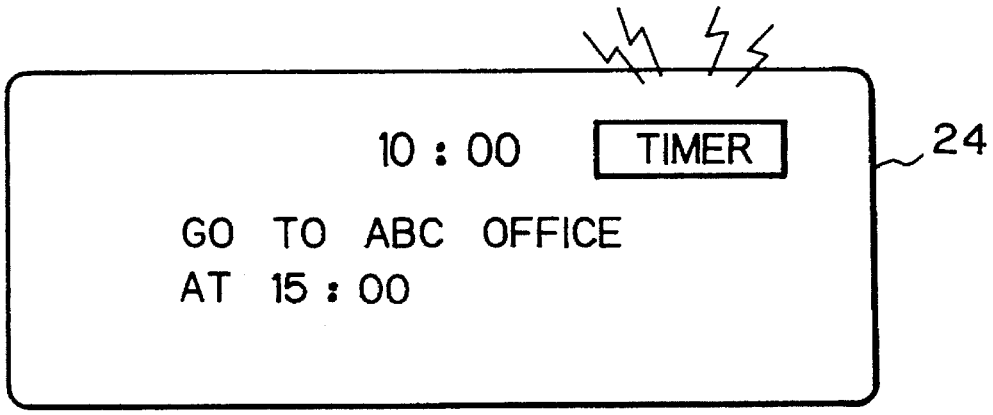
FIG. 5 shows a specific message including time data and appearing on the display.

FIGS. 4 and 5 each shows a specific appearing on the display 24. A message without time data is simply displayed on the display 24, as shown in FIG. 4. On the other hand, as shown in FIG. 5, when the message contains time data, an indicator labeled "TIMER" flashes on the display 24 while the message is displayed. It is to be noted that "9:00" and "10:00" shown in FIGS. 4 and 5, respectively, are each representative of the current time indicated by the timepiece 28.

Assume that the user continuously presses the reset switch 26 for a predetermined period of time, e.g., 2 seconds in the illustrative embodiment while the indicator "TIMER" is flashing as mentioned above. Then, the setting circuit 38 sends a signal representative of such a condition to the decoder 14. In response, the decoder 14 determines that a realert command has been entered, stores the message of interest in the memory 40, and informs the time message identifying circuit 32 of the realert command. Then, the time message identifying circuit 32 sends only the time data contained in the message to the time comparing circuit 34. The time comparing circuit 34 compares the time data with the current time indicated by the timepiece 28 to thereby determine an interval therebetween and sends the determined interval to the counter 36. The counter 36 starts counting down a period of time which is 30 minutes shorter than the interval sent from the time comparing circuit 34. On fully counting down such a period of time, the counter 36 informs the decoder 14 of the end of count-down. Why the counter 30 starts down-counting a period of time 30 minutes shorter than the interval sent thereto is to produce an alert tone 30 minutes earlier than the time indicated by the message, urging the user to see it again before the time elapses. In this sense, 30 minutes is merely an examplary period and not limiting. In response to the output of the counter 36, the decoder 14 causes the speaker driver 18 to produce an alert tone via the speaker 20 and, at the same time, reads the message out of the memory 40 and displays it on the display 24 via the display driver 22.

How the time message identifying circuit 32 identifies time data included in a message is as follows. Usually, numerals, alphabets and other symbols are sent in the form of a coded message signal. In the case of POCSAG code, for example, one character has seven bits. FIG. 6 shows a specific data code table according to POCSAG code. As shown, the alphabet A, for example, is sent as a signal "1000001 while the numeral 3 is sent as a signal "1100110". Regarding the bit Nos. 5, 6 and 7, both the numerals and the symbol ": (colon)" commonly used to indicate time are represented by "110" Therefore, several symbols including numerals and the symbol ":" can be readily distinguished from the alphabets and other symbols only if the bit Nos. 5, 6 and 7 are checked. More specifically, checking only three bits suffices to identify numerals and symbol ":".

As shown in FIG. 7, time data included in a message is generally made up of numerals and symbol ":" and represented by four or five characters. Regarding the bit Nos. 5, 6 and 7, both the numerals and the symbol ":" are "110", as stated above. Also, the symbol ":" is preceded by one or two characters and followed by two characters. The time message identifying circuit 32, therefore, stores such a pattern, i.e., a pattern having four or five consecutive characters whose bit Nos. 5, 6 and 7 are "110" and having the symbol ":" as the second or third character as counted from the beginning. The circuit 32 compares the input message signal with the stored pattern and, if the former is coincident with the latter, determines that the message signal contains time data.

The above-stated method of identifying time data is only illustrative and not limiting. Alternatively, the time message identifying circuit 32 may be so constructed as to check all of the seven bits to see if the symbol ":" is present and, if it is present, check the seven bits again to determine whether or not the symbol ":" is preceded by one or two numerals and followed by two numerals.

Figure 8A:
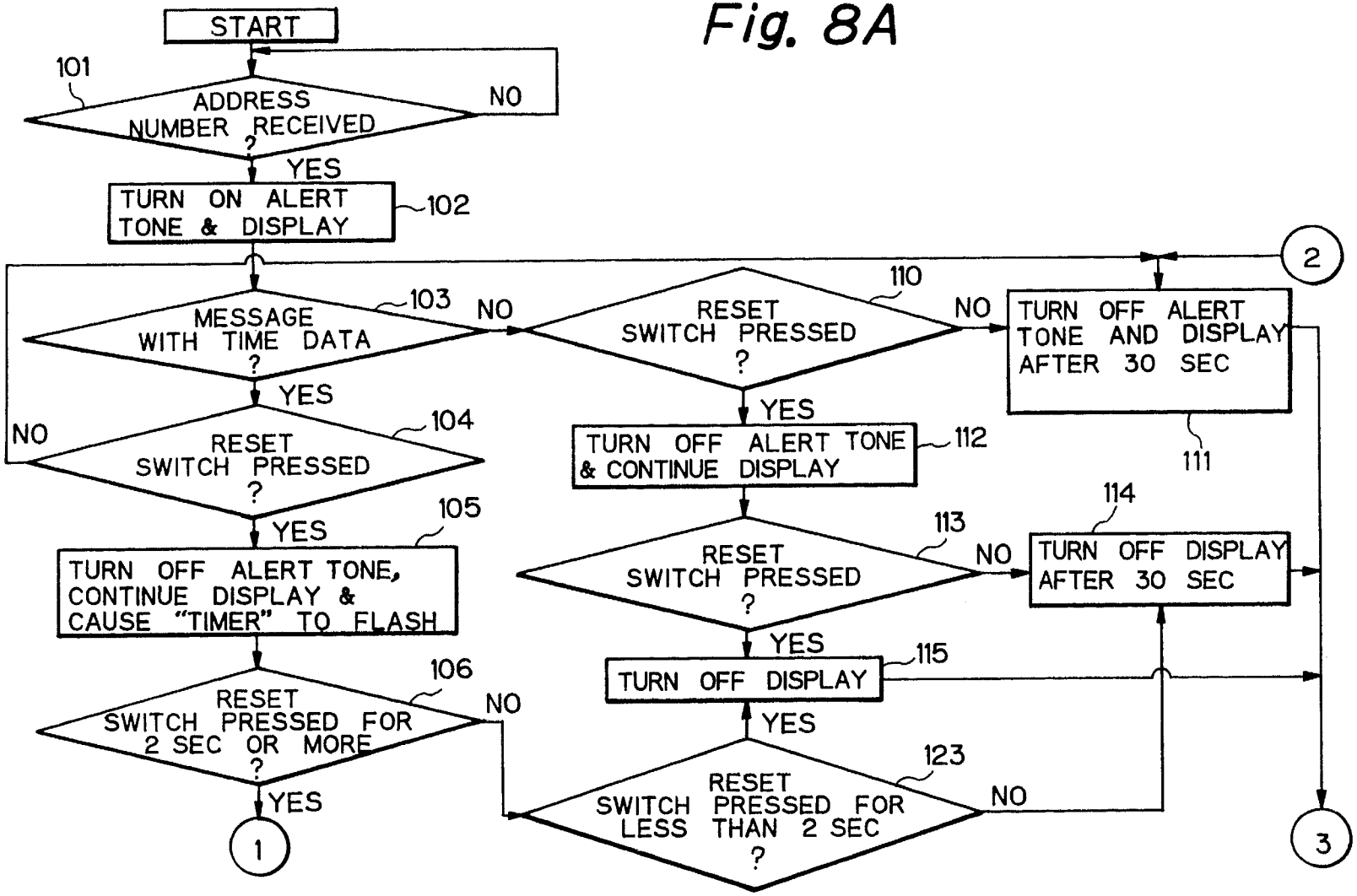
FIGS. 8A and 8B are flowcharts demonstrating a specific operation of the embodiment.
Figure 8B:
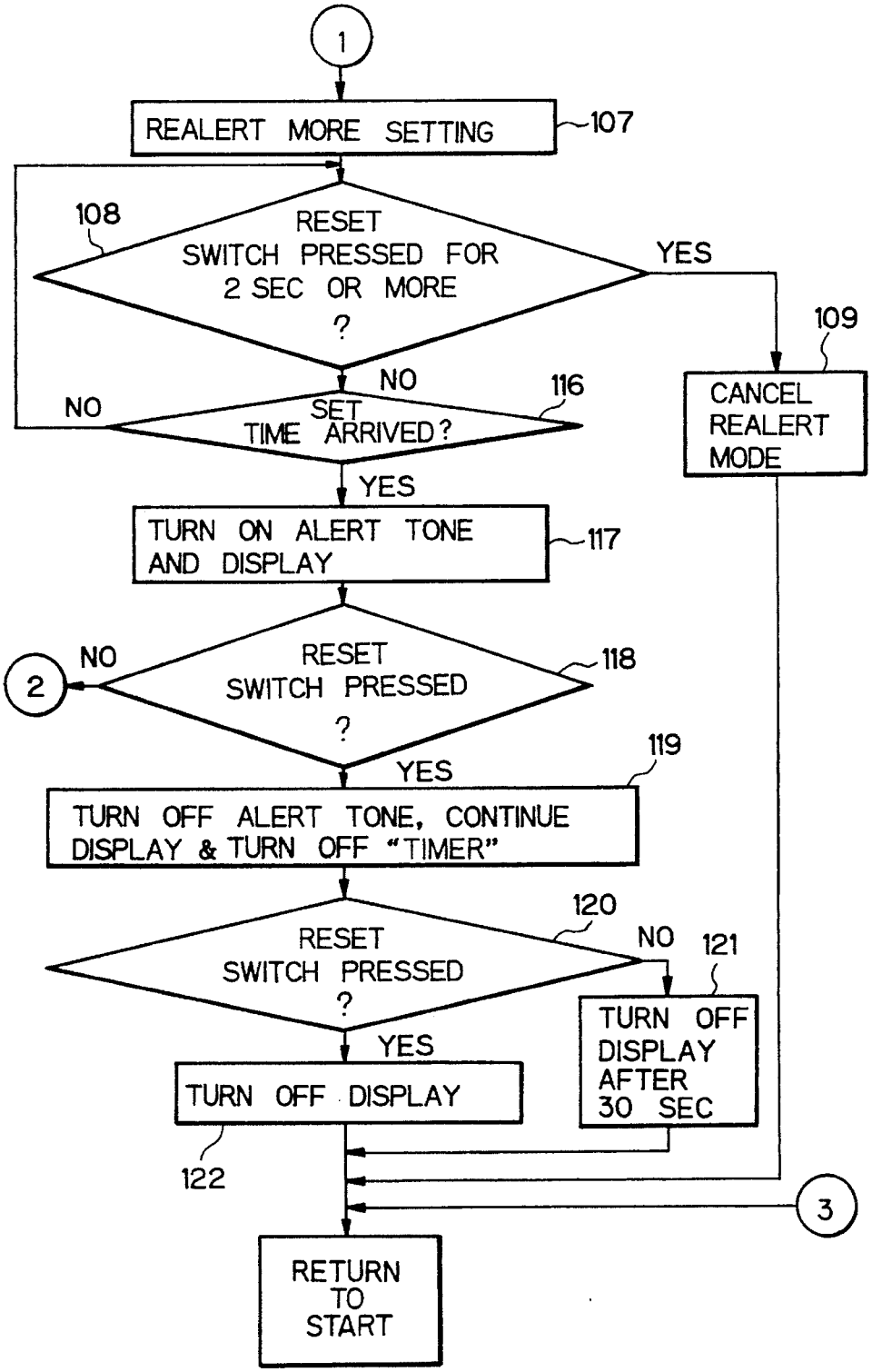

A reference will be made to FIGS. 8A and 8B for describing a more specific operation of the radio pager 30. As shown in FIG. 8A, the operation begins with a step 101 for determining whether or not the pager 30 has received a signal meant for the pager 30. Specifically, in the step 101, the decoder 14 receives a signal via the antenna 10 and radio section 12, and compares an address number included in the received signal with the preassigned address number stored in the ROM 16 to see if the former is identical with the latter. If the two address numbers are identical (YES, step 101), the decoder 14 causes the speaker driver 18 to produce an alert tone via the speaker 20 and, if the address number is followed by a message, decodes it and displays it on the display 24 via the display driver 22 (step 102). At the same time, the decoder 14 transfers the received message to the time message identifying circuit 32 to cause it to see if the message includes time data (step 103). If the message does not include time data as determined by the time message identifying circuit 32 (NO, step 103), whether or not the reset switch 26 has been pressed is determined in response to the output of the setting circuit 38 (step 110). If the answer of the step 110 is positive, YES, the decoder 14 stops the alert tone while continuously displaying the message (step 112). Subsequently, the decoder 14 determines whether or not the reset switch 26 has been pressed again (step 113). If the reset switch 26 has been pressed again (YES, step 113), the decoder 14 turns off the message on the display 24 (step 115) and then returns to the step 101. If the reset switch 26 is not pressed after the turn-off of the alert tone (NO, step 113), the decoder 14 turns off the message on the display 24 on the elapse of 30 seconds (step 114) and then returns to the step 101.

If the message does not include time data as determined in the step 103 and if the reset switch 26 is not pressed again as determined in the step 110, the decoder 114 turns off both the message and the alert tone on the elapse of 30 seconds (step 111) and then returns to the step 101. When the message includes time data (YES, step 103) and the reset switch 26 is not pressed afterwards (NO, step 104), the program 111 also advances to the step 111 for turning off the message and alert tone on the elapse of 30 seconds and then returns to the step 101.

Assume that the message includes time data (YES, step 103), and that the reset switch 26 is pressed again (YES, step 104). Then, the decoder 14 turns off the alert tone while continuously displaying the message and, at the same time, causes the indicator "TIMER" to flash (step 105). Subsequently, the decoder 14 determines whether or not the reset switch 26 has been continuously pressed for 2 seconds or more (step 106). If the answer of the step 106 is negative, NO, the decoder 14 further determines whether or not the reset switch 26 has been pressed for less than 2 seconds (step 123). If the answer of the step 123 is positive, YES, the decoder 14 turns off the message (step 115) and then returns to the step 101.

Assume that the decoder 14 determines that the reset switch 26 has been continuously pressed for 2 seconds or more in response to the output of the setting circuit 38 (YES, step 106). Then, the operation is transferred from the step 106 of FIG. 8A to a step 107 of FIG. 8B. In the step 107, the decoder 14 sets up a realert mode for producing an alert tone and displaying the message again 30 minutes earlier than the time indicated by the time data of the message. Specifically, in the step 107, the decoder 14 writes the message in the memory 40 and informs the time message identifying circuit 32 of the realert mode. In response, the identifying circuit 32 transfers the time data included in the message signal to the time comparing circuit 34. The time comparing circuit 34 determines the interval between the time indicated by the time data and the current time and feeds it to the counter 36. The counter 36 starts counting down a period of time which is 30 minutes shorter than the above-mentioned interval. The decoder 14 turns off the message on the display 24 and causes the indicator "TIMER" to stop flashing and, instead, causes it to continuously glow.

Assume that the decoder 14 responsive to the output of the setting circuit 38 determines that the reset switch 26 has been continuously pressed for 2 seconds or more in the realert mode, i.e., while the indicator "TIMER" is glowing (YES, step 108). Then, the decoder 14 cancels the realert mode and turns off the indicator "TIMER"(step 109) and then returns to the step 101. If the answer of the step 108 is negative, NO, and as the counter 36 completes counting down, i.e., reaches the alert time which is 30 minutes earlier than the time indicated by the time data of the message (YES, step 116), the decoder 14 again produces an alert tone via the speaker 20 and again displays the message stored in the memory 40 on the display 24 in response to the resulting output of the counter 36 (step 117). At this instant, the decoder 14 cancels the realert mode meant for the message of interest to thereby prevent the alert tone and message from being repeated 24 hours layer. Afterwards, if the reset switch 26 is not pressed (NO, step 118), the decoder 14 returns to the step 111, FIG. 8A, for turning off the message and alert toner on the elapse of 30 seconds and then returns to the step 101. If the reset switch 26 is pressed as determined in the step 118, the decoder 14 turns off the alert tone and indicator "TIMER" while continuously displaying the message (step 119). Subsequently, if the reset switch 26 is again pressed as determined in a step 120, the decoder 14 turns off the message on the display (step 122) and then returns to the step 101; if otherwise (NO, step 120), the decoder 14 turns off the message on the elapse of 30 seconds (step 21) and then returns to the step 101.

The radio pager 30 again alerts the user to the call 30 minutes earlier than the time indicated by the time information of the message, as stated above. With the illustrative embodiment, it is also possible for the user to set any desired realert time simply by operating a switch, as follows.

Figure 9:
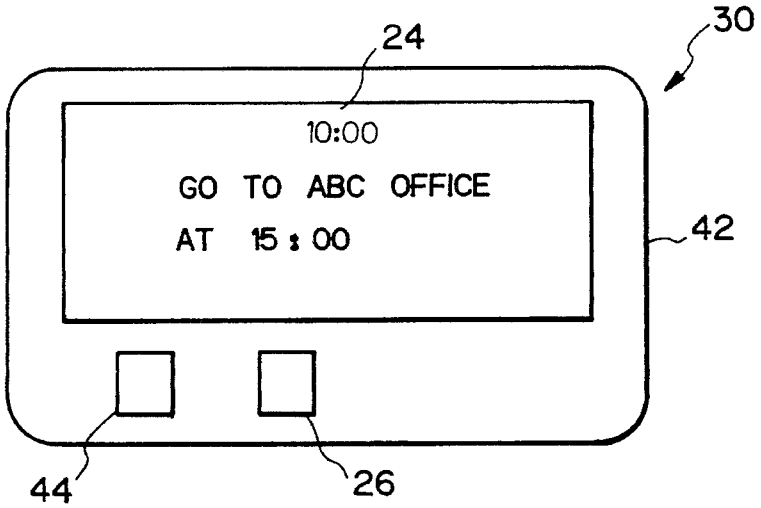
FIG. 9 is a view showing the external appearance of the embodiment.

FIG. 9 is an external view of the data display radio pager 30 having a casing 42 and a power switch 44 as well as the display 24 and reset switch 26. When the power switch 44 is turned on, the pager 30 produces an alert tone to show the user that it is operable. On receiving a call, the pager 30 produces an alert tone to inform the user of the call and, if a message is present, displays it on the display 24. As the user presses the reset switch 26, the alert tone is stopped while the message on the display 24 is not turned off. When the user presses the reset switch 26 again, the message on the display 24 disappears. Assuming old messages are stored in the memory 40, they sequentially appear on the display 24 on the operation of the reset switch 26, the newest message first. At this instant, if any one of the message includes time data, the realert mode can be set up.

Figure 10:
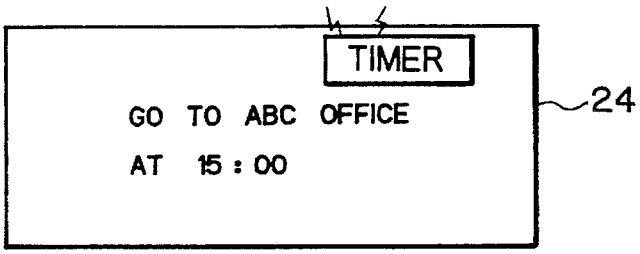
Figure 1:
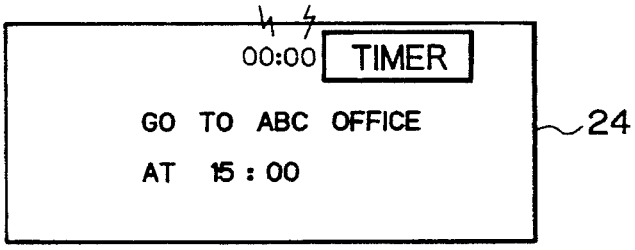
Figure 12:
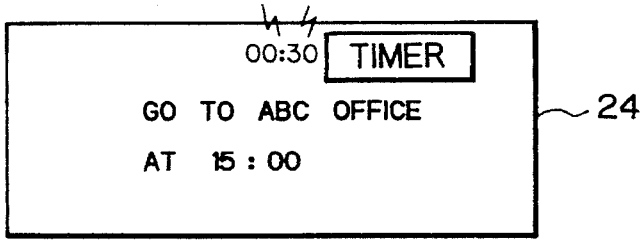

After a message with time data has been shown on the display 24, the user may press the reset switch 26 for two seconds to set up the realert mode. Then, the indicator "TIMER" flashes on the display 24, as shown in FIG. 10. When the user presses the reset switch 26 for less than 2 seconds, the current time appearing on the display 24 is replaced with time "0:00" which flashes, as shown in FIG. 11. As the user presses the reset switch 26 again, time "0:00" appears in place of "0:00" and flashes, as shown in FIG. 12. In this manner, 30 minutes are added to the time every time the reset switch 26 is pressed for less than 2 seconds; pressing the reset switch 26 while "12:00" is displayed will again set up the condition shown in FIG. 10. As the operator sets a desired realert time on the display 24 and then presses the reset switch 26 for more than 2 seconds, the realert mode is set up. Thereafter, the pager 30 returns to an ordinary mode for awaiting the arrival of a call. On the other hand, as the user presses the reset switch 26 for two seconds or more in the condition shown in FIG. 10, the realert mode is cancelled and replaced with the ordinary mode.

The alert mode will also be replaced with the ordinary mode when 20 seconds elapses without the reset switch 26 being pressed. It is to be noted that the circuitry associated with the reset switch 26 does not operate when the switch 26 is pressed and operates when it is released.

Figure 13A:
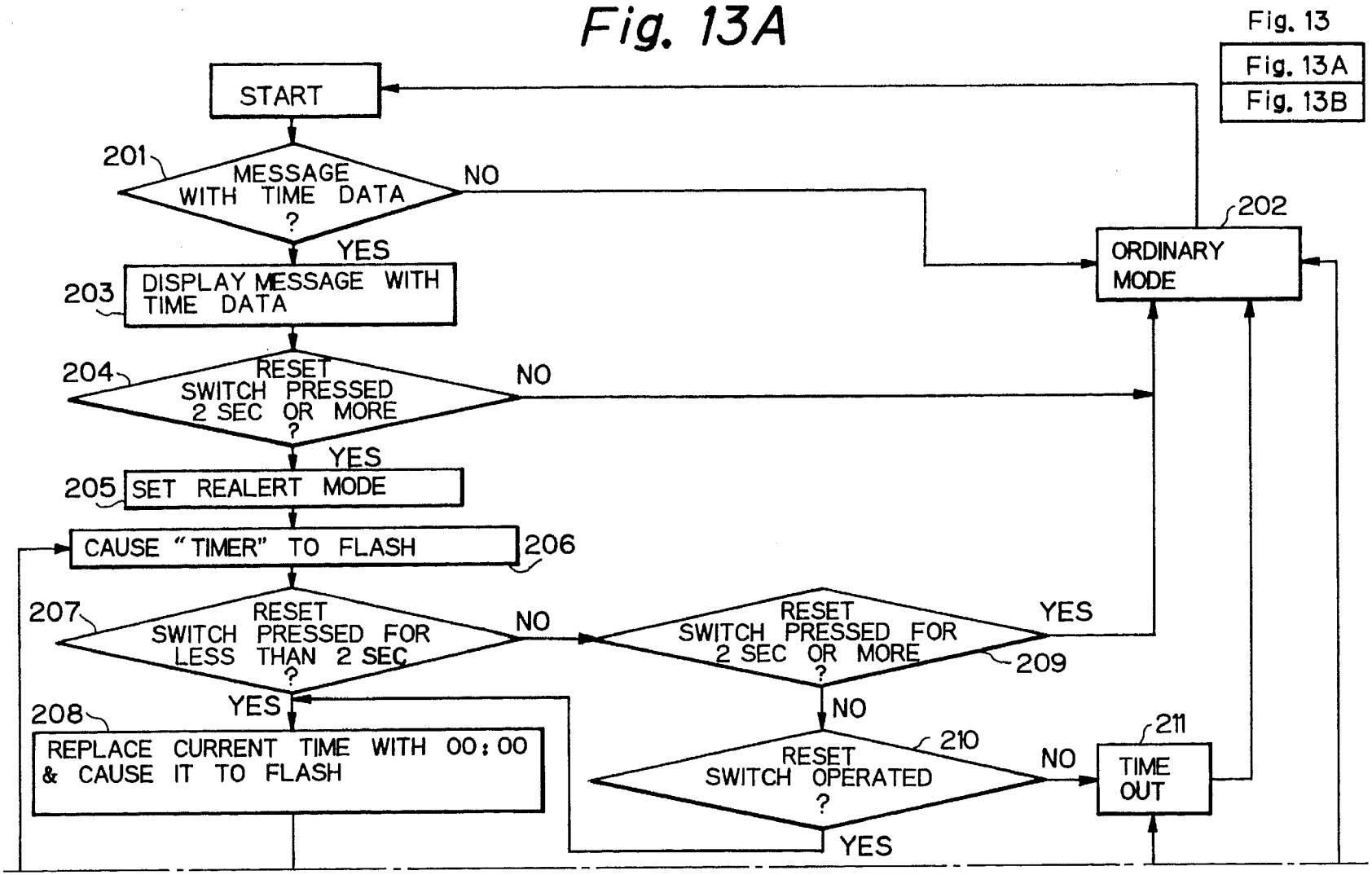
FIGS. 13A and 13B provide a flowchart associated with FIGS. 10–12.
Figure 13B:
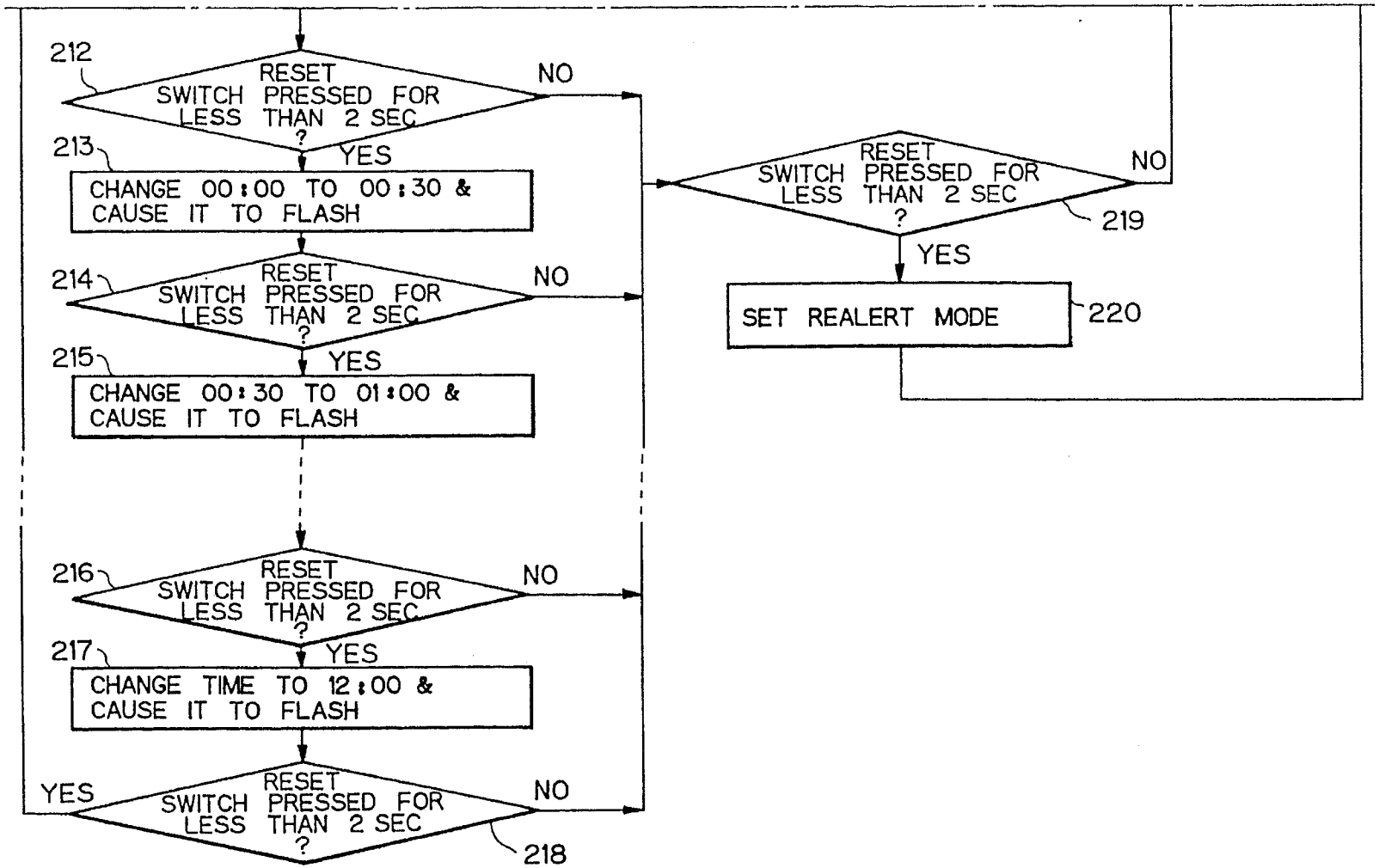

How to set up the realert mode will be described more specifically with reference to FIGS. 13A and 13B. Assume that a message with time data and a message without time data have been received. The procedure begins with a step 201 in which the reset switch 26 is operated to sequentially display the messages on the display 24. Every time a message appears on the display 24, whether it includes time data or not is determined. With the message with time data, only the ordinary operation is effected (step 202). After the message with time data has been selected and displayed (203), the reset switch 26 may be pressed for 2 seconds or more to set up the realert mode (step 205). If the reset switch 26 is not pressed for 2 seconds or more, the ordinary mode is effected (step 202).

When the realert mode is set up in the step 205, the indicator "TIMER" flashes (step 206). In this condition, as the reset switch 26 is pressed for less than 2 seconds (step 207), the current time appearing on the display 24 changes into time "0:00" and flashes (step 208). When the reset switch 26 is pressed for more than 2 seconds (step 209), the program returns to the ordinary mode (step 202). When 20 seconds expires without the reset switch 26 being pressed after the transition to the realert mode (step 210), the realert mode is replaced with the ordinary mode (202) via a step 211 (TIME OUT). Further, when the reset switch 26 is pressed for less than 2 seconds (step 212), "0:00" appearing and flashing on the display 24 changes into "0:30"(step 213). When the reset switch 26 is pressed again for less than 2 seconds (step 214), "0:00" flashing on the display 24 changes into "1:00" (step 215). Thereafter, the time flashing on the display 24 is incremented by 30 minutes every time the reset switch 26 is pressed for less than 2 seconds. When the reset switch 26 is pressed for less than 2 seconds after the time has been increment to "11:30" by the above procedure, the time changes into "12:00" and flashes (step 217). As the reset switch 26 is pressed for less than 2 seconds (step 218), the program returns to the step 206.

The circuitry associated with the reset switch 26 does not operate when the switch 26 is pressed and operates when it is released, as stated earlier. After a desired time has been set on the reset switch 26, the reset switch 26 may be pressed for at least 2 seconds (step 219) to set up the realert mode (step 220).

If the reset switch 26 is not pressed for 2 seconds or more as determined in the step 219, the realert mode is replaced with the ordinary mode (step 202) via the step 211.

In summary, in accordance with the present invention, a data display radio pager realerts, when received a message with time data, the user at a particular time based on the time data, e.g., 30 minutes earlier than the time indicated by the time data while displaying the message again. This urges the user to reconfirm a message received in the past before the time indicated by the message arrives, thereby preventing the user from, for example, forgetting an appointment. The present invention, therefore, makes the most of the message displaying function available with a data display radio pager.

Various modifications will become possible for those skilled in the art after receiving the teachings of the present disclosure without departing from the scope thereof.

What is claimed is:

1. A pager capable of generating an alert signal and displaying a message received by said pager, comprising:

a time message identifying circuit connected to receive said message and determine whether said message contains time data, said time message identifying circuit outputting a time data signal indicating that time data is present in said message and extracting said time date from said message;

a memory connected to receive and store said message as a realert message when said time message identifying circuit indicates that time data is present;

a display coupled to receive said time data signal and including a time data message portion for indicating to a user of said pager that said message includes time data in response to said time data signal;

a time comparing circuit coupled to said time message identifying circuit, said time comparing circuit comparing a current time with said time data extracted by said time message identifying circuit and calculating a time interval between said current time and a time indicated by said time data;

a counter connected to receive said time interval from said comparing circuit, said counter counting a period of time to produce a realert signal, said period of time being less than said time interval by a predetermined amount of time; and realert means responsive to said realert signal for displaying said realert message stored in said memory and for generating an alert to said user.

2. A pager as recited in claim 1, wherein said time message identifying circuit comprises:

means for determining whether characters in said message are numbers or other characters;

means for identifying a time indicating character in said message, said time indicating character being a character used to display time in a message; and means for determining when a next two characters immediately following said time indicating character are numbers and when at least one character immediately preceding said time indicating character is also a number to identify said time data and for outputting said time data signal when said time data is identified.

3. A pager as recited in claim 1, wherein said message is characterized in that a time indicating character and numbers belong to a set of characters exclusive of letters, said set of characters being characterized in that three particular bit locations of character data for each of said characters have an identical bit pattern, said time indicating character being a character used to display time in a message.

4. A pager as recited in claim 3, wherein said time message identifying circuit comprises comparing means for comparing a stored pattern with character data with a character string in said message and for outputting said time data signal when said character string matches said stored pattern.

5. A pager as recited in claim 4, wherein said comparison of said comparing means is accomplished by comparing only three bits in said three bit locations for a first, third and fourth character in said character string with said identical bit pattern and by comparing a second character in said character string with character data defining said time indicating character.

6. A pager as recited in claim 4, wherein said comparison of said comparing means is accomplished by comparing only three bits in said three bit locations for a first, second, fourth and fifth character in said character string with said identical bit pattern and by comparing a third character in said character string with character data defining said time indicating character.

* * * * *